US008388056B2

(12) United States Patent
Smith et al.

(10) Patent No.: US 8,388,056 B2
(45) Date of Patent: Mar. 5, 2013

(54) HEATED COLLAPSIBLE ARTICLE OF FURNITURE

(76) Inventors: ReAnna Gayle Smith, Columbia, IL (US); Kyle Matthew Smith, Columbia, IL (US)

( * ) Notice: Subject to any disclaimer, the term of this patent is extended or adjusted under 35 U.S.C. 154(b) by 240 days.

(21) Appl. No.: 12/437,823

(22) Filed: May 8, 2009

(65) Prior Publication Data

US 2010/0283295 A1 Nov. 11, 2010

(51) Int. Cl.
*A47C 7/72* (2006.01)

(52) U.S. Cl. ..... 297/180.12; 297/16.2; 297/217.3

(58) Field of Classification Search ..... 297/13.1, 297/16.2, 180.12, 217.3, 16, 217.31, 16.1
See application file for complete search history.

(56) References Cited

U.S. PATENT DOCUMENTS

| | | | | |
|---|---|---|---|---|
| 2,706,237 | A * | 4/1955 | Hare et al. | 219/390 |
| 2,731,542 | A * | 1/1956 | Daniels | 219/217 |
| 3,427,431 | A | 2/1969 | Costanzo | |
| 3,500,014 | A | 3/1970 | Longo | |
| 3,621,192 | A | 11/1971 | Pohler | |
| 4,279,255 | A | 7/1981 | Hoffman | |
| 4,413,857 | A | 11/1983 | Hayashi | |
| 4,869,550 | A * | 9/1989 | Lorenzen et al. | 297/180.12 |
| 4,933,618 | A * | 6/1990 | Ortlieb | 318/640 |
| 4,969,684 | A * | 11/1990 | Zarotti | 297/180.12 |
| 5,034,594 | A | 7/1991 | Beezhold et al. | |
| 5,067,771 | A | 11/1991 | Ellis | |
| 5,211,172 | A * | 5/1993 | McGuane et al. | 607/95 |
| 5,259,379 | A | 11/1993 | Kim et al. | |
| 5,489,142 | A | 2/1996 | Mathieu | |
| 5,516,189 | A * | 5/1996 | Ligeras | 297/180.11 |
| 5,623,919 | A | 4/1997 | Kelly | |
| 5,639,143 | A * | 6/1997 | Ackerman | 297/180.12 |
| 5,709,428 | A * | 1/1998 | Hugghins | 297/16.2 |
| 5,893,608 | A * | 4/1999 | Cravenor | 297/217.3 |
| 5,915,783 | A * | 6/1999 | McDowell et al. | 297/180.12 |
| 5,944,384 | A * | 8/1999 | Patterson | 297/344.23 |
| 5,975,630 | A * | 11/1999 | Schreiber | 297/217.3 |
| 6,164,726 | A | 12/2000 | Reeves et al. | |
| 6,220,659 | B1 * | 4/2001 | McDowell et al. | 297/180.12 |
| 6,382,715 | B1 | 5/2002 | Tang | |
| 6,439,658 | B1 * | 8/2002 | Ganz et al. | 297/180.14 |
| 6,505,885 | B1 * | 1/2003 | Tang | 297/16.2 |
| 6,554,898 | B2 | 4/2003 | Lu et al. | |
| 6,657,170 | B2 | 12/2003 | Clothier | |
| 6,686,562 | B1 | 2/2004 | Weiss et al. | |
| 6,792,671 | B1 * | 9/2004 | Oberg | 29/611 |
| 6,814,408 | B2 * | 11/2004 | Chen | 297/284.6 |
| 6,817,446 | B1 | 11/2004 | Bisland | |

(Continued)

FOREIGN PATENT DOCUMENTS

| | | | |
|---|---|---|---|
| BE | 1016033 | * | 1/2006 |
| DE | 3803903 A1 | * | 8/1989 |

(Continued)

*Primary Examiner* — David Dunn
*Assistant Examiner* — David E Allred
(74) *Attorney, Agent, or Firm* — Armstrong Teasdale LLP

(57) ABSTRACT

A heated collapsible article of furniture is provided. The article of furniture has a collapsible frame movable from an open orientation to a collapsed orientation. A heating element is formed integrally with the article of furniture and is configured for converting electrical energy to thermal energy. A rechargeable electrical storage device is couple to the heating element and configured to receive electrical energy photovoltaically and provide the electrical energy to the heating element.

19 Claims, 6 Drawing Sheets

U.S. PATENT DOCUMENTS

| | | | | |
|---|---|---|---|---|
| 6,848,746 | B2 | 2/2005 | Gentry | |
| 6,914,217 | B2 | 7/2005 | Fristedt | |
| 6,988,770 | B2 * | 1/2006 | Witchie | 297/180.14 |
| 7,025,418 | B1 * | 4/2006 | Hackal | 297/217.3 |
| 7,045,743 | B2 | 5/2006 | Park | |
| 7,053,344 | B1 * | 5/2006 | Surjan et al. | 219/549 |
| 7,066,534 | B2 | 6/2006 | Choi | |
| 7,090,297 | B2 * | 8/2006 | Mohn et al. | 297/330 |
| RE39,394 | E | 11/2006 | Suzuki et al. | |
| 7,131,187 | B2 | 11/2006 | Check et al. | |
| 7,134,715 | B1 * | 11/2006 | Fristedt et al. | 297/180.12 |
| 7,172,247 | B2 * | 2/2007 | Beloch et al. | 297/284.7 |
| 7,178,866 | B1 | 2/2007 | Scott | |
| 7,202,444 | B2 | 4/2007 | Bulgajewski | |
| 7,229,128 | B2 * | 6/2007 | Lee | 297/16.2 |
| 7,240,962 | B2 | 7/2007 | Kim | |
| 7,244,914 | B2 | 7/2007 | Yoneyama et al. | |
| 7,250,586 | B2 | 7/2007 | Diemer et al. | |
| 7,306,283 | B2 * | 12/2007 | Howick et al. | 297/180.12 |
| 7,317,176 | B2 * | 1/2008 | Boucher | 219/546 |
| 7,370,911 | B2 | 5/2008 | Bajic et al. | |
| 7,422,277 | B2 | 9/2008 | Chen | |
| 7,427,101 | B1 * | 9/2008 | Zernov | 297/184.14 |
| 7,438,356 | B2 | 10/2008 | Howman et al. | |
| 7,500,536 | B2 | 3/2009 | Bulgajewski et al. | |
| 7,506,927 | B1 | 3/2009 | Williams | |
| 7,665,803 | B2 * | 2/2010 | Wolas | 297/180.13 |
| 7,802,844 | B1 * | 9/2010 | Vencill | 297/184.14 |
| 7,866,743 | B1 * | 1/2011 | Russell et al. | 297/180.12 |
| 2002/0149237 | A1 * | 10/2002 | Muller | 297/61 |
| 2003/0127885 | A1 * | 7/2003 | Tang | 297/16.2 |
| 2004/0155506 | A1 * | 8/2004 | Gentry | 297/380 |
| 2004/0188418 | A1 * | 9/2004 | Aisenbrey | 219/528 |
| 2005/0168021 | A1 * | 8/2005 | Real et al. | 297/217.3 |
| 2005/0242635 | A1 * | 11/2005 | Cassaday | 297/217.3 |
| 2006/0138818 | A1 * | 6/2006 | Stitt | 297/217.3 |
| 2007/0013213 | A1 | 1/2007 | Axinte et al. | |
| 2007/0102974 | A1 * | 5/2007 | Chen | 297/217.4 |
| 2007/0152479 | A1 | 7/2007 | Howman et al. | |
| 2008/0001449 | A1 | 1/2008 | Moon | |
| 2008/0041282 | A1 * | 2/2008 | Goschy et al. | 108/141 |
| 2008/0211684 | A1 * | 9/2008 | Beck | 340/667 |
| 2008/0282928 | A1 * | 11/2008 | Flom | 104/173.2 |
| 2009/0051196 | A1 * | 2/2009 | Ishii et al. | 297/180.12 |
| 2009/0072594 | A1 | 3/2009 | Korytowski | |
| 2010/0032998 | A1 * | 2/2010 | Eckman et al. | 297/217.3 |
| 2010/0038356 | A1 * | 2/2010 | Fukuda et al. | 219/549 |
| 2010/0038357 | A1 * | 2/2010 | Fukuda et al. | 219/553 |
| 2010/0233924 | A1 * | 9/2010 | Le Gette et al. | 441/130 |
| 2010/0301640 | A1 * | 12/2010 | Heiser | 297/135 |
| 2010/0326976 | A1 * | 12/2010 | Nakajima et al. | 219/217 |
| 2011/0163576 | A1 * | 7/2011 | Akai et al. | 297/180.12 |
| 2011/0169308 | A1 * | 7/2011 | Carter et al. | 297/217.3 |
| 2011/0174926 | A1 * | 7/2011 | Margis et al. | 244/118.6 |
| 2011/0175403 | A1 * | 7/2011 | Kinskey et al. | 297/16.1 |
| 2011/0181078 | A1 * | 7/2011 | Kelly et al. | 297/16.1 |
| 2011/0193372 | A1 * | 8/2011 | Pizzuto | 297/16.1 |

FOREIGN PATENT DOCUMENTS

| | | | | |
|---|---|---|---|---|
| DE | 19511753 | A1 | | 10/1996 |
| DE | 10123654 | C1 | | 7/2002 |
| EP | 347969 | A | * | 5/1989 |
| RU | 2197411 | | * | 1/2003 |

* cited by examiner

HEATED COLLAPSIBLE ARTICLE OF FURNITURE

BACKGROUND OF THE INVENTION

The field of this disclosure relates generally to collapsible articles of furniture, and more particularly, to heated collapsible articles of furniture.

Known collapsible (i.e., foldable) articles of furniture include a variety of different types of articles, including for example chairs or stands. Collapsible chairs are often referred to as camping chairs and are generally collapsed for storage when not in use. Collapsible stands may be used as foot rests or tables, and are similarly generally collapsed when not in use. The collapsible articles are often used outdoors in the elements and as such, the articles may be exposed to the elements and to a wide range of temperatures.

To provide a more comfortable environment to individuals using such chairs in adverse weather conditions (i.e., cold temperatures), some known stadium chairs include battery-powered heating elements. Generally such chairs are fairly rigid and the heating elements provide a limited amount of heat for a limited period of time commiserate with the life of the battery. After the battery has been discharged, it must either be replaced or recharged before any additional heat can be provided by the seated occupant. Stadium chairs are often used in areas where such batteries may not be easily recharged with an auxiliary power source. As such, because continuous and uninterrupted use of the heating element is generally not feasible. Users of such seats are often required to transport multiple replacement batteries with the stadium chair if they desire to receive heat in the chair for an extended period of time.

Other known collapsible chairs include pockets that are sized to receive packets therein. When the chemicals in such packets are mixed together, the resulting chemical reaction generates heat that is releases from the pocket when the packet is inserted therein. However, similar to the battery-powered heating elements, such chemical packets provide only limited heat for limited periods of time.

BRIEF DESCRIPTION OF THE INVENTION

In one embodiment, an article of furniture is provided. The article of furniture includes: a collapsible frame movable from an open orientation to a collapsed orientation; at least one heating element formed integrally within said article of furniture, said at least one heating element configured to convert electrical energy to thermal energy; and a rechargeable electrical storage device coupled to said at least one heating element, said rechargeable electrical storage device configured to: receive electrical energy photovoltaically; and provide electrical energy to said at least one heating element.

In another embodiment, a chair is provided. The chair includes: a collapsible frame movable from an open orientation wherein at least a portion of the user's body is receivable therein, to a collapsed orientation wherein at least a portion of a user's body is not receivable therein; a cover coupled to said collapsible frame; at least one heating element integrally formed within at least said cover, said at least one heating element configured to convert electrical energy to thermal energy; and a rechargeable electrical storage device coupled to said at least one heating element, said rechargeable electrical storage device configured to receive electrical energy photovoltaically, and to provide electrical energy to said at least one heating element.

In yet another embodiment, an article of furniture is provided. The article of furniture includes a frame movable from a fully open orientation, to a fully collapsed orientation; a cover coupled to said frame, at least a portion of said cover suspended substantially from said frame when said frame is in said open orientation; at least one heating element extending through at least a portion of said cover, said heating element configured to convert electrical energy to thermal energy; and a rechargeable electrical storage device coupled to said at least one heating element, said rechargeable electrical storage device configured to receive electrical energy photovoltaically, and to provide electrical energy to said at least one heating element, and said rechargeable electrical storage device comprises a photovoltaic component configured to convert light into electrical energy.

DETAILED DESCRIPTION OF THE INVENTION

Figure 1:
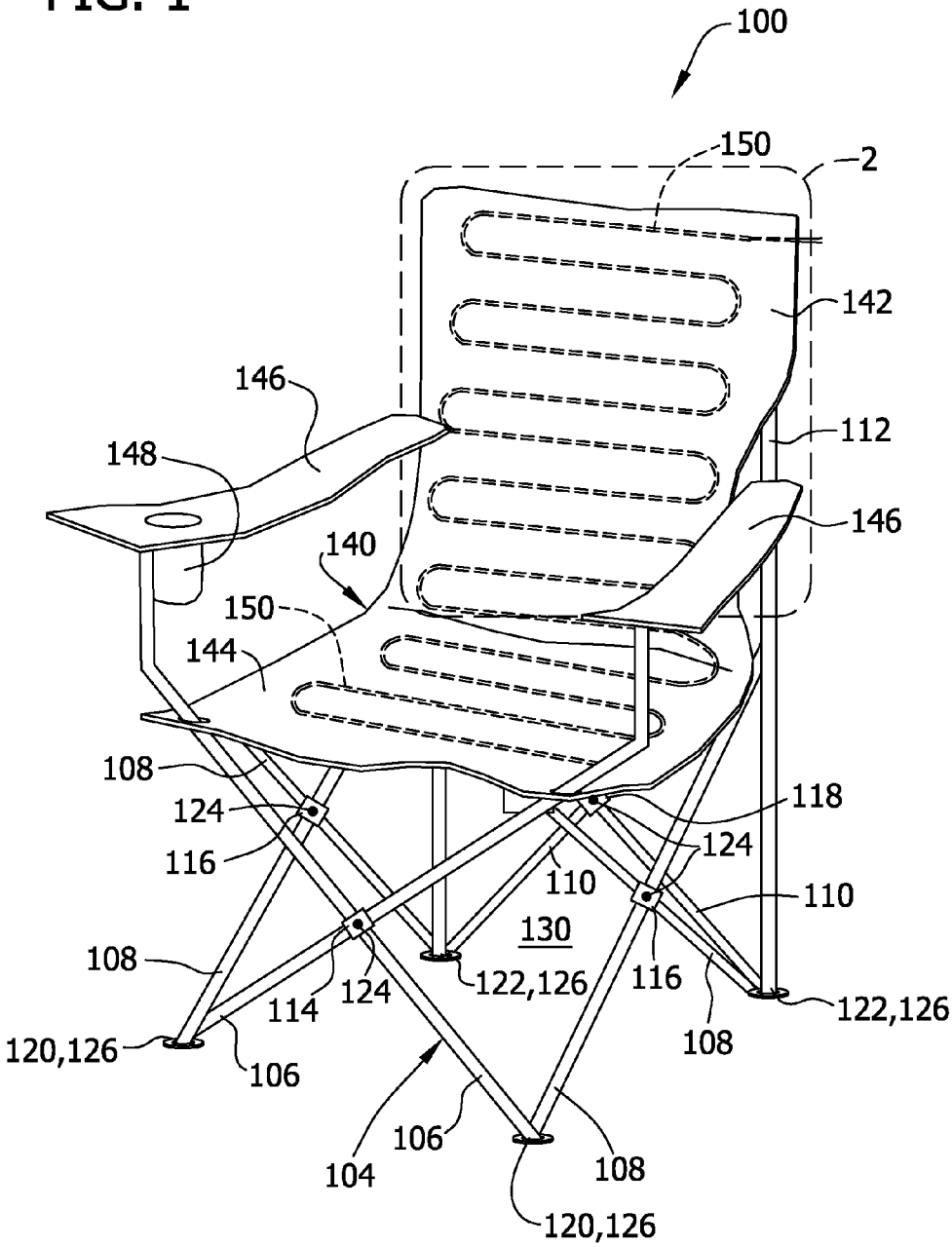
FIG. 1 is a perspective view of an exemplary heated collapsible chair.

FIG. 1 is a perspective view of an exemplary chair 100. The present invention is not limited to being used only with a chair. Rather, the present invention may be used with any article of furniture, such as, but not limited to, stands or foot rests. In the exemplary embodiment, chair 100 includes a collapsible frame 104. Frame 104 includes a plurality of front frame members 106, side frame members 108, and rear frame members 110. Frame 104 also includes a plurality of upper members 112 that extend generally vertically upwards from respective rear frame members 110. Front frame members 106 are coupled together at a front pivot assembly 114, and side frame members 108 and rear frame members 110 are coupled together at a respective side pivot assembly 116 and a rear pivot assembly 118. Front frame members 106 and side frame members 108 are also coupled together at front lower pivot assemblies 120, and rear frame members 110 and side frame members 108 are coupled together at rear lower pivot assemblies 122. Pivots 124 couple front pivot assembly 114, side pivot assemblies 116, rear pivot assemblies 118, and the approximate midpoints of members 106, 108, and 110. Front lower pivot assemblies 120 and rear lower pivot assemblies 122 also have feet 126 coupled thereto. Pivot assemblies 114, 116, 118, 120, 122 and pivots 124 connect all the frame members to each other, such that chair 100 is coupled together as a unitary assembly. Frame 104 may be known as an X-frame. Accordingly, frame 104 is movable from the an open orientation wherein a central area 130 is substantially open, to a closed orientation wherein the size of the central area 130 is substantially reduced.

In the exemplary embodiment, chair 100 also includes a covering 140 that includes a back portion 142 and a seat portion 144. Portions 142 and 144 may be formed from separate pieces of material or from a single unitary piece of material. Moreover, portions 142 and 144 are coupled to frame 104 such that a load applied to either portion 142 or 144 (e.g., by an individual sitting in the chair 100) is transferred to frame 104. Covering 140 may be fabricated from any material (e.g., fabric) that has sufficient structural strength to support the weight of an individual seated within chair 100. Additionally, covering 140 may be constructed out of a material that is resistant to moisture and/or sunlight. In the exemplary embodiment, chair 100 includes arm rests 146 that may be formed either integrally or separate from cover 140. Arm rests 146 are suitably coupled to at least a portion of the frame 104 and are sized to permit an individual to rest their arms thereon when seated in chair 100. In the exemplary embodiment, each arm rest 146 includes at least one cup holder 148. Cup holders 148 may be formed integrally with, or attached to, armrests 146.

In the exemplary embodiment, chair 100 includes at least one heating element 150. More specifically, in the exemplary embodiment, one or both of portions 142 and 144 includes a heating element 150 integrated therein. As shown in FIG. 1, portions of heating element 150 positioned in front portion 144 may be formed continuously with portions extending within back portion 142 (i.e., a single heating element extends within both portions). As disclosed herein, heating element 150 is "integrated within" such that heating element 150 is either coupled thereto, or is formed integrally with either portion 142 and/or 144, and as such is not readily removed. For example, heating element 150 may be encased between two separate layers (not shown) that together form covering 140. Alternatively, heating element may be bonded to, or otherwise attached to, a surface of covering 140. Alternatively, heating element 150 may be integrated within arm rests 146 and cup holders 148. In some embodiments, heating element 150 is integrated within arm rest 146 and/or cup holders 148.

Heating element 150 is an electrical resistance type heater in the exemplary embodiment. Alternatively, heating element 150 may be any type of electrically powered heating element that enables chair 100 to function as described therein. In the exemplary embodiment, heating element 150 generates heat by converting electrical energy into heat energy by passing current through one or more conductors that restrict the flow of electricity therethrough. This restriction results in the generation of heat. An amount of heat energy generated by heating element 150 is dependent on a variety of factors, such as, but not limited to, the type of material from which heating element 150 is fabricated and/or the voltage and amount of electricity flowing therethrough (i.e., the current).

Figure 2:
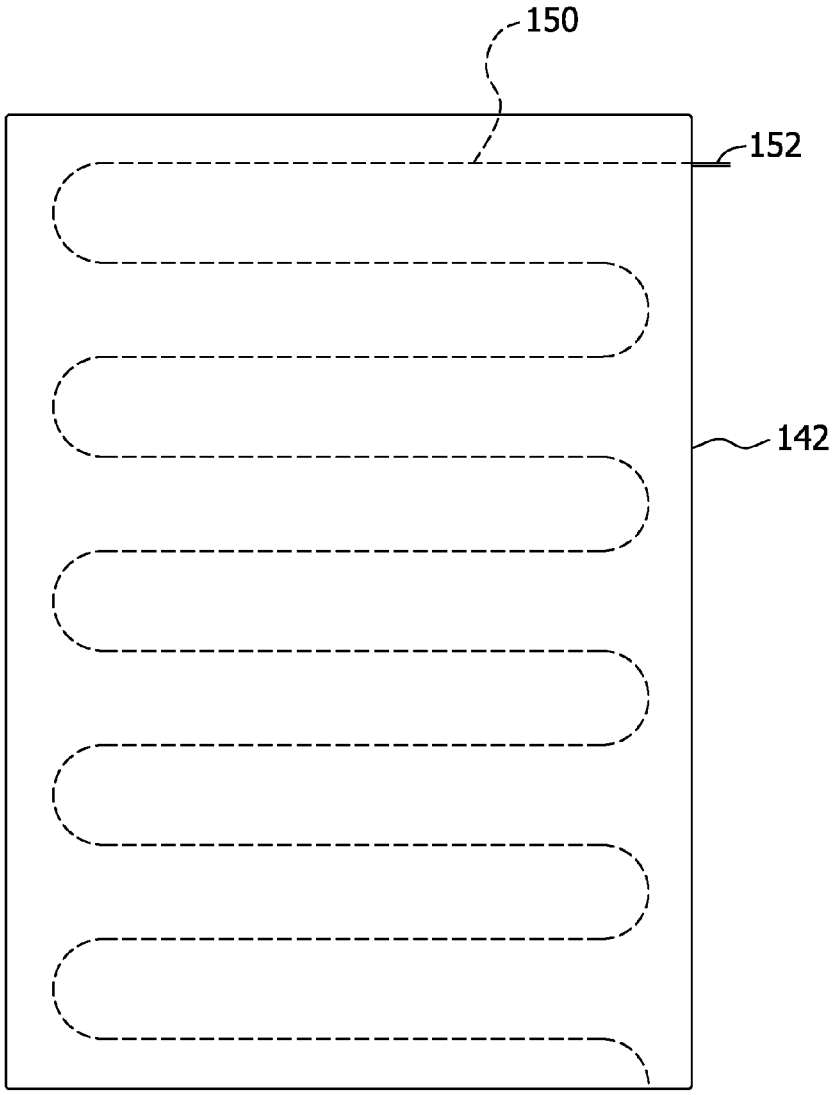
FIG. 2 is a top plan view of a portion of the collapsible chair shown in FIG. 1 and taken along area 2.
Figure 3:
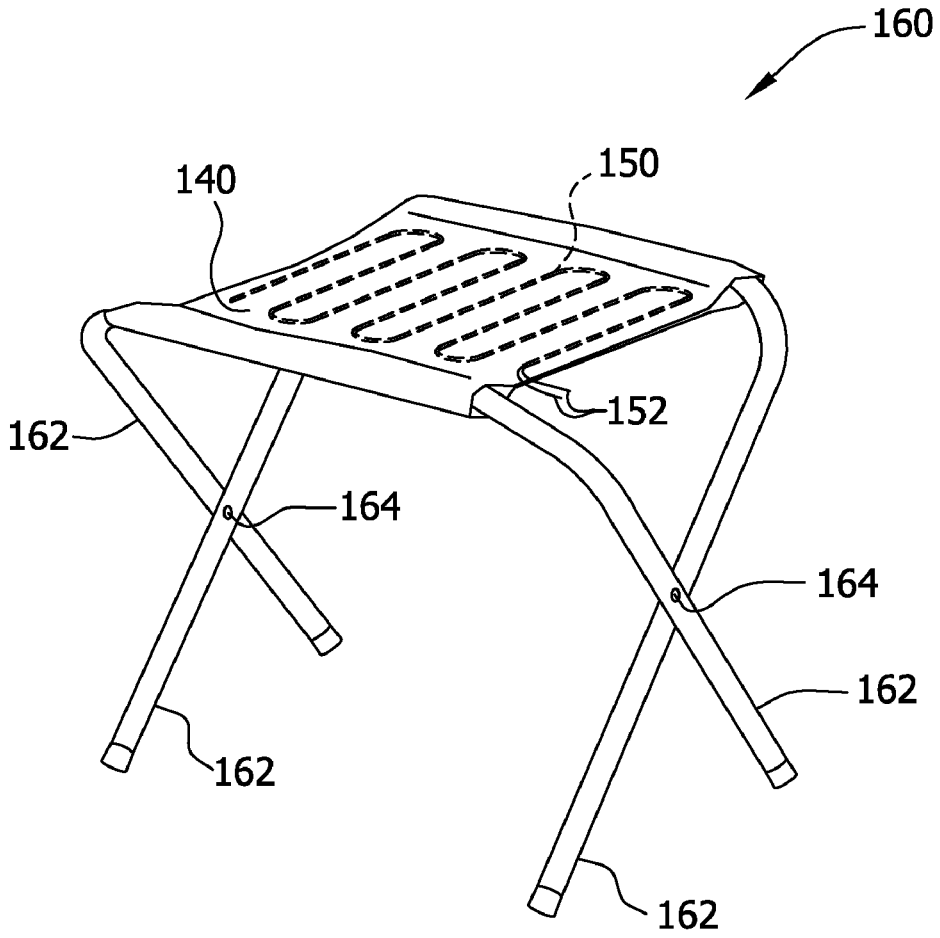
FIG. 3 is a perspective view of an exemplary heated collapsible foot rest.

In another embodiment, heating element 150 is formed integrally with the fabric or other material which forms portions 142 and/or 144. One example of a material suitable for use in chair 100 is FabRoc produced by EXO2 of Lanarkshire, United Kingdom. Materials such as FabRoc are fabrics with a specific structure that generates heat when electrical current is passed therethrough. Such conductive materials may be used for covering 140, for example. As described herein, covering 140 has two layers (i.e. a top and a bottom layer) as shown in FIGS. 1 and 3. The top layer receives and contacts a user's body and the bottom layer is opposite the top layer. As shown in FIG. 2, electrical leads 152 provide an electrical connection to supply electrical energy to the conductive material via heating element 150, which, in the exemplary embodiment, is oriented directly between the top and bottom layer in a serpentine path.

Moreover, a length of heating element 150 used in the chair 100 may also affect the amount of heat generated therefrom, as the amount of heat generated is at least partially based on an amount of surface area or a length of heating element 150. For example, in one orientation a relatively long length (e.g., 8 meters) of heating element 150 is integrated into back portion 142 and front portion 144. In another embodiment, a relatively short length (e.g., 2 meters) of heating element 150 is used. In comparison, if both heating elements 150 use the same materials (i.e., both are fabricated with the same thickness), the orientation using the longer heating element 150 will thus generate a greater amount of heat and should require a correspondingly greater amount of electricity input thereto.

FIG. 2 is a plan view of a portion of heating element 150. More specifically, FIG. 2 illustrates the portion of heating element 150 integrated into chair 100 back portion 142 in the exemplary embodiment. Heating element 150 is arranged in a serpentine or generally looped orientation and includes a pair of electrical leads 152 that extend from back portion 142. Electrical leads 152 provide an electrical connection point wherein a source of electrical energy may be electrically connected to heating element 150. Heating element 150 may be fabricated into back portion 142 by enclosing heating element 150 between two separate layers (not shown).

Figure 4:
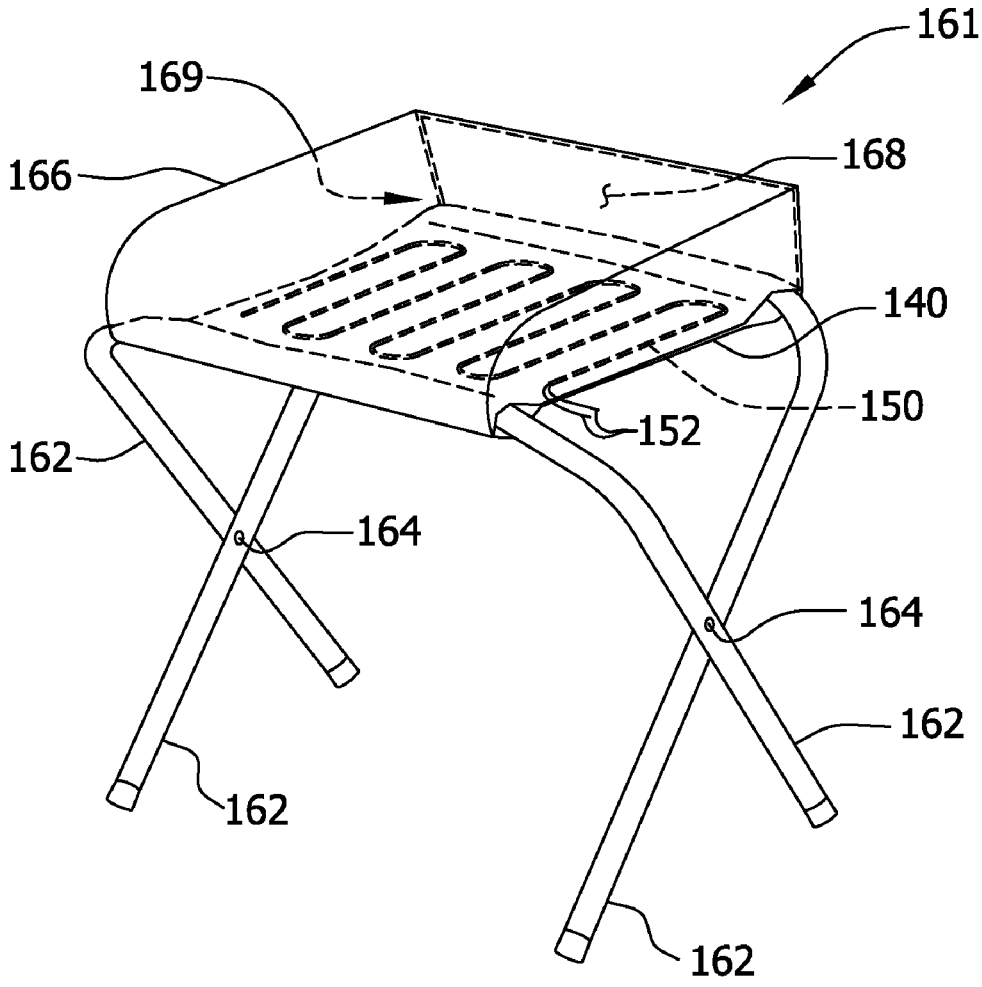
FIG. 4 is a perspective view of an alternative embodiment of a heated collapsible foot rest.

FIGS. 3 and 4 illustrate exemplary orientations of a heating element 150 integrated into a respective stand 160 (shown in FIG. 3) and an alternative stand 161 (shown in FIG. 4). Stands 160 and 161 may be formed separately from chair 100 (shown in FIGS. 1 and 2), or alternatively, stands 160 and/or stand 161 may be coupled to chair 100 in an appropriate position such that when a user is seated on chair 100 stands 160 and/or 161 provide an area for the user to rest their feet. In each exemplary embodiment, stand 160 and 161 includes a pair of supports 162 that are coupled together at pivots 164. Moreover, because supports 162 are pivotably coupled together, stands 160 and 161 is collapsible into a closed orientation as when supports 162 are pivoted about pivots 164 in a similar manner as described above for chair 100. Covering 140 is coupled to and suspended between supports 162. Integrated within covering 140 are heating elements 150 which likewise function in a similar manner to those used in chair 100. Moreover, in the exemplary embodiment, electrical leads 152 protrude from covering 140 to enable heating element 150 be coupled to a source of electrical energy.

In the exemplary embodiment, stand 161 is similar to stand 160, with the exception that stand 161 also includes an enclosure 166 extending from covering 140. In the exemplary embodiment, enclosure 166 is fabricated from the same material as covering 140 and may also include heating element 150 formed integrally within. An opening 168 formed in enclosure 166 is sized to receive at least a portion of an individual's feet or other body part therein. Thus when enclosure 166 is used in conjunction with heating elements 150, an individual may warm their feet or other portions of their body (e.g., hands) by inserting them into a cavity 169 bounded by the enclosure 166 and covering 140. Other objects may be placed in area 169 as well, such as food or drinks. Additionally, opening 168 may have a closure mechanism (not shown) that permits the opening 168 to be substantially closed, such that heat generated by heating elements 150 is further restricted from exiting cavity 169. Such a closure mechanism may be, but is not limited to, a zipper, snaps, clasps, buttons, a hook and loop fastener system, and/or an adhesive.

In another embodiment, an enclosure similar to enclosure 166 may be utilized in addition with, or in the alternative, other portions of chair 100. For example, an enclosure may suspended from, or formed with at least one arm rest 146. Another enclosure may likewise be coupled to back portion 142 and/or seat portion 144 and configured to extend over at least a portion of the individual's body or head.

Figure 5:
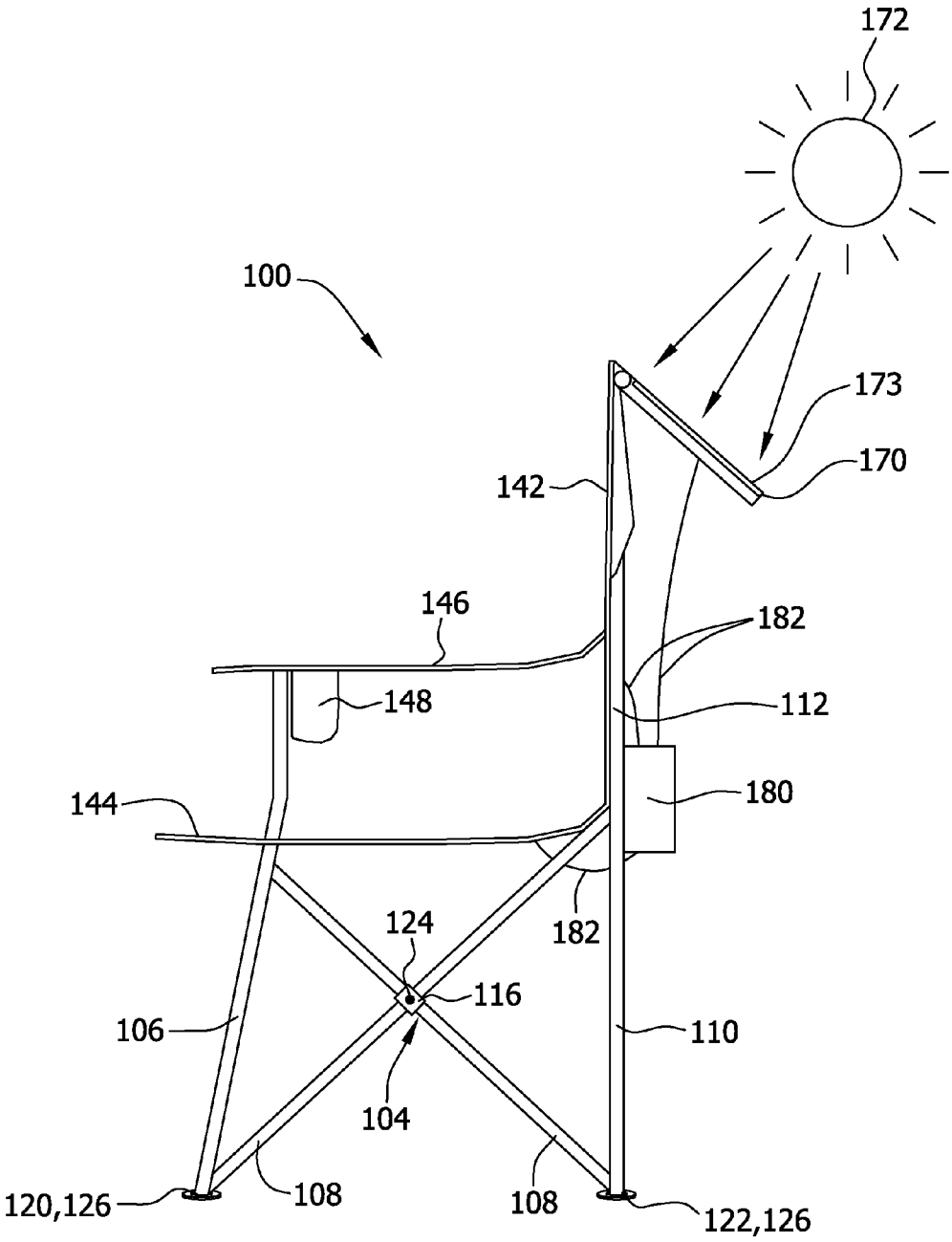
FIG. 5 is a side view of the collapsible chair shown in FIG. 1.

FIG. 5 is a side view of chair 100. In the exemplary embodiment, heating element 150 is coupled via electrical leads 152 to a battery 180. Battery 180 is coupled to a photovoltaic device 170 that provides electrical energy to battery 180. In alternative embodiments, electrical energy is supplied directly to electrical leads 152 of heating element 150 by photovoltaic device 170, and battery 180 is used only as a back-up power source, or chair 100 does not include battery 180. A control panel (not shown in FIG. 5) is used to control a flow of electrical energy to heating element 150 (shown in FIGS. 1 and 2).

Photovoltaic device 170 may be any known device that converts solar energy into electrical energy, such as a solar cell. In the exemplary embodiment, the source of light is the sun 172. Alternatively, other light sources may be used to provide solar energy. Photovoltaic device 170 may be coupled to any portion of chair 100 and/or stand 160. Furthermore, photovoltaic device 170 may be coupled with a hinge or any other articulating coupling that permits photovoltaic device 170 to be variably positioned for optimum exposure to light (i.e., orientated such that an outer surface 173 of photovoltaic device 170 is facing towards the sun or other light source). Alternatively, photovoltaic device 170 may not be coupled to chair 100 or stand 160 and may be a "free-standing" or "stand alone" type of device.

In another embodiment, the photovoltaic device 170 may be integrated into a canopy or other structure disposed generally above chair 100. The canopy is used in conjunction with chair 100 and provides shade from the sun to a user seated therein. The canopy may be releasably coupled to chair 100, or it may be a "free-standing" or "stand alone" type of structure. The canopy has material suspended from a suitably sized frame such that it provides an adequately sized shaded area for a user seated in chair 100. The photovoltaic device 170 is coupled to an outer surface of the canopy such that it is positioned for optimum exposure to light (i.e., orientated such that the outer surface 173 is facing towards the sun or other light source).

In yet another embodiment, the photovoltaic device 170 may integrated into an outer surface or covering of a bag or other container (not shown) configured to receive the chair 100 when in a collapsed orientation for storage or transport. Accordingly, the battery 180 may be charged by the photovoltaic device 170 while the chair 100 is collapsed and stored within the bag or other container.

Battery 180 may be any device capable of storing electrical energy and providing such energy selectively to heating element 150 as described herein, such as, without limitation, a lithium-ion battery, a lead-acid battery, a nickel-cadmium battery, a nickel-metal hydride battery, an alkaline battery, or a capacitor. Battery 180 may be coupled to any portion of chair 100 or stand 160, 161 or, alternatively, the battery is not coupled to either the chair or stand. For example, battery 180 may be contained in an enclosure, such as enclosure 166 (shown in FIG. 4). In some embodiments, battery 180 is a rechargeable battery that is capable of repeated charging and discharging cycles. Such batteries are often referred to as "secondary electrochemical cells" and include lithium-ion and nickel-metal hydride batteries, for example. Wires 182 electrically couple photovoltaic device 170 to battery 180 and also couple battery 180 to heating element 150. Alternatively, wires 182 may electrically couple photovoltaic device 170 directly to heating element 150.

Figure 6:
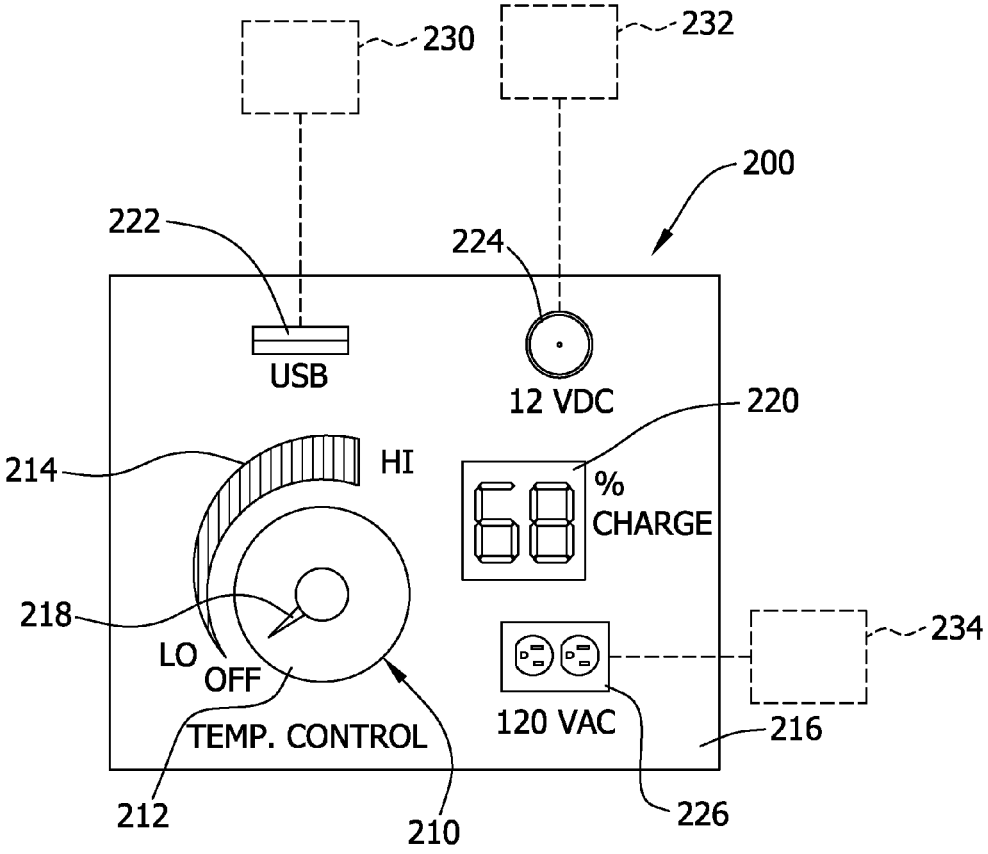
FIG. 6 is a side view of an exemplary control panel that may be used with the exemplary collapsible chair shown in FIG. 1.

FIG. 6 is a side view of an exemplary control panel 200 that may be used with chair 100 and/or with stand 160. In the exemplary embodiment, control panel 200 is electrically coupled to heating element 150, photovoltaic device 170, and battery 180. Control panel 200 functions to control an amount of electrical energy supplied to heating elements 150 from either photovoltaic device 170 or battery 180. In alternative embodiments, the control panel 200, photovoltaic device 170, and battery 180 may be located separately and detached from chair 100 and/or stand 161. In this alternative embodiment, a single control panel 200, photovoltaic device 170, and battery 180 may be used to provide electrical energy to multiple chairs 100 or stands 160. The control panel 200, photovoltaic device 170, and battery 180 may be co-located together, and multiple chairs 100 may be electrically coupled thereto with electrical extension cords or other electrical connectors. Moreover, multiple photovoltaic devices 170 or batteries 180 may be used in conjunction with the control panel 200 to power either one or more chairs 100.

In the exemplary embodiment, control panel 200 includes a temperature control 210 that is used to regulate an amount of heat generated by heating element 150. Temperature control 210 can include a knob 212 that is rotatably coupled to an electrical control device (not shown). A scale 214 is printed or otherwise affixed to a surface 216 of control panel 200. Scale 214 can indicate a range of temperatures or desired comfort levels. Knob 212 is thus rotated by an individual until a pointer 218 or other indicia thereon is aligned with a desired point on scale 214 corresponding to either a specific temperature or a general comfort level setting (e.g., hot, warm, or off).

The electrical control device used with temperature control 210 can vary an amount of current or voltage supplied to heating element 150 in one embodiment. Alternatively, electrical control device is a thermostat which selectively controls an amount of electrical energy to heating element 150 based on a measured temperature and a set point. The thermostat thus monitors the temperature of a point on the chair 100 adjacent to heating element 150 with a thermocouple or other suitable device.

A charge indicator 220 is also provided in control panel 200 in the form of a numeric display. Charge indicator 220 presents a visual indication of an amount of charge or "useful life" remaining in battery 180. This indication can be expressed as a percentage of the total charge which battery 180 is capable of storing. In the exemplary embodiment, the indication is presented on a digital display.

Auxiliary electrical connectors 222, 224, and 226 are included as well in control panel 200. Connectors 222, 224, and 226 enable electrically-powered accessories to be coupled to control panel 200, and in turn to battery 180 and/or photovoltaic device 170. Accordingly, connectors 222, 224, and 226 enable electrical energy to be transferred to the accessories 230, 232, 234 from either photovoltaic device 170 or battery 180, such that the accessories may be electrically charged.

Varieties of different types of electrical connectors 222, 224, and 226 are included in the exemplary embodiment. For example, electrical connectors 222, 224, and 226 may be, but are not limited to, a Universal Serial Bus (USB) connector (i.e., connector 222), a 12 volt direct current accessory plug (i.e., a cigarette lighter plug (i.e., connector 224)), and/or a 120 volt alternating current electrical socket (i.e., connector 226). Accordingly, electrical energy may be supplied from either battery 180 or photovoltaic device 170 to electrically powered accessories 230, 232, 234 (e.g., a wireless phone charger, a digital media player, a digital music player, a radio, a television, an electrical appliance, or a computing device) via control panel 200 through connectors 222, 224, and 226.

In another embodiment, at least one of connectors 222, 224, and 226 is an electrical connector that enables an electrical input source (i.e., an extension cord) to be electrically coupled to control panel 200 and to supply battery 180 with electrical energy. Control panel 200 is thus able to charge battery 180 independent of photovoltaic device 170. Charging battery 180 in such a manner is useful when access to other sources of electrical energy is available.

The embodiments disclosed herein provide for heating articles of furniture with electrical heating elements. Electrical energy is supplied to the heating elements from a photovoltaic device. The photovoltaic device may be used to charge a battery which in turn supplies the heating elements with electrical energy. Accordingly, the heated article of furniture may be utilized in environments without ready access to other sources of electrical energy, such as in remote areas. Moreover, through the use of the battery in conjunction with the photovoltaic device an auxiliary power source is provided which is capable of powering accessory devices.

The embodiments describe present multiple advantages over known heated stadium chairs. For example, chair 100 is flexible, in that it is foldable into a collapsed orientation when in not in use and expandable to an open orientation when in use. The power source used to heat the chair is also rechargeable from a self-contained power source that does not require the input of electrical energy from an external source. Moreover, the self-contained power source may be used to provide electrical energy to other devices.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. An article of furniture, said article comprising:

a collapsible frame comprising a pair of armrests, said frame movable from an open orientation, to a collapsed orientation, wherein when said frame is in the open orientation said armrests are substantially parallel and spaced farther apart than when said frame is in the collapsed orientation;

a covering comprising only two layers comprising first and second layers of conductive material coupled to said collapsible frame such that a load applied to said covering is transferred to said collapsible frame, said first layer positioned to directly contact the load;

at least one heating element positioned between and against said first and second layers of material, said at least one heating element configured to convert electrical energy to thermal energy, wherein said at least one heating element extends through said covering in a serpentine electrical path;

at least one electrical connection configured to supply electrical energy to the conductive material of the covering to cause current to flow through substantially all of said covering to facilitate distributing heat through substantially all of said covering; and an electrical storage device coupled to said at least one heating element, said electrical storage device configured to:

receive electrical energy photovoltaically; and provide electrical energy to said at least one heating element and said electrical connection.

2. An article in accordance with claim 1, wherein said article of furniture comprises a collapsible chair.

3. An article in accordance with claim 1, wherein said electrical storage device comprises a photovoltaic component configured for converting light into electrical energy.

4. An article in accordance with claim 1, wherein said at least one heating element is formed integrally into at least one of a back portion and a seat portion of said article.

5. An article in accordance with claim 1, further comprising an enclosure at least one of coupled to said article of furniture and formed integrally with said article of furniture.

6. An article in accordance with claim 5, wherein said enclosure comprises at least one heating element formed integrally within said enclosure.

7. An article in accordance with claim 1, further comprising at least one control system for controlling the flow of electrical energy supplied by said electrical storage device to said at least one heating element.

8. A chair comprising:

a collapsible frame comprising a pair of armrests, said frame movable from an open orientation wherein at least a portion of the user's body is receivable therein, to a collapsed orientation wherein at least a portion of a user's body is not receivable therein, wherein when said frame is in the open orientation said armrests are spaced a distance apart that is greater than a distance said armrests are when said frame is in the collapsed orientation;

a cover comprising only first and second layers of conductive material coupled to said collapsible frame such that a load applied to said cover by the user's body is transferred to said collapsible frame, said first layer positioned to directly contact the user's body;

at least one heating element configured to convert electrical energy to thermal energy, wherein said at least one heating element extends in a serpentine path through and directly contacts said first and second layers of conductive material and enables current to flow through substantially all of said cover to facilitate distributing heat through substantially all of said cover; and an electrical storage device coupled to said at least one heating element and said first and second layers of conductive material, said electrical storage device configured to at least receive electrical energy photovoltaically, and to provide electrical energy to said at least one heating element and said first and second layers of conductive material.

9. A chair in accordance with claim 8, wherein said electrical storage device comprises a photovoltaic component configured for converting light into electrical energy.

10. A chair in accordance with claim 8, further comprising one or more electrical coupling devices coupled to said electrical storage device.

11. A chair in accordance with claim 10, wherein said one or more electrical coupling devices are operable to provide electrical energy to accessory devices.

12. A chair in accordance with claim 11, wherein electrical accessory devices comprise: a digital music player, a radio, a television, and an electrical appliance.

13. A chair of in accordance with claim 10, wherein said one or more electrical coupling devices are operable to electrically couple said electrical storage device to an external source of electrical energy.

14. An article of furniture comprising:

a frame comprising a pair of armrests and being movable from a fully open orientation, to a fully collapsed orientation, wherein when said frame is in the fully open orientation said armrests are spaced a distance apart that is greater than a distance between said armrests when said frame is in the fully collapsed orientation;

a cover comprising only first and second layers of material coupled to said frame, at least a portion of said cover suspended substantially from said frame when said frame is in said open orientation, said first layer positioned to directly contact a load;

at least one heating element extending through at least a portion of said cover, said heating element configured to convert electrical energy to thermal energy, wherein said at least one heating element extends in a serpentine path through and directly contacts said first and second layers of material and enables current to flow through substantially all of said cover to facilitate distributing heat through substantially all of said cover; and an electrical storage device coupled to said at least one heating element, said electrical storage device configured to receive electrical energy photovoltaically, and to provide electrical energy to said at least one heating element and said cover, and said electrical storage device comprises a photovoltaic component configured to convert light into electrical energy.

15. An article of furniture in accordance with claim 14 further comprising at least one electrical coupling device coupled to said electrical storage device.

16. An article of furniture in accordance with claim 14, further comprising a foot rest coupled to said collapsible frame, said foot rest having a support portion for supporting at least a portion of a user's body.

17. An article of furniture in accordance with claim 16, wherein said foot rest comprises at least one electrical resistance heating element integrally formed within at least a portion of said foot rest and coupled to said electrical storage device.

18. An article of furniture comprising:

a frame comprising a pair of armrests being movable between a fully open orientation and a fully collapsed orientation, wherein when said frame is in the fully open orientation said armrests are spaced farther apart than when said frame is in the fully collapsed orientation;

a cover comprising only first and second layers of conductive material coupled to said frame, at least a portion of said cover is suspended from said frame when said frame is in said open orientation, said cover comprising at least one heating element positioned between and directly contacting said first and second layers of conductive material, said at least one heating element configured to convert electrical energy to thermal energy to selectively induce heat within said cover, wherein said at least one heating element extends through said cover in a serpentine electrical path that causes current to flow through substantially all of said cover to distribute heat through substantially all of said cover; and an electrical storage device coupled to said at least one heating element, said electrical storage device configured to provide electrical energy to said at least one heating element and said cover.

19. An article of furniture in accordance with claim 15 wherein said at least one electrical coupling device is operable to electrically couple said electrical storage device to an external source of electrical energy.

* * * * *